US010087928B2

(12) United States Patent
Eschner

(10) Patent No.: US 10,087,928 B2
(45) Date of Patent: Oct. 2, 2018

(54) SCREW SPINDLE PUMP

(71) Applicant: Klaus Union GmbH & Co. KG, Bochum (DE)

(72) Inventor: Thomas Eschner, Bochum (DE)

(73) Assignee: KLAUS UNION GMBH & CO. KG, Bochum (DE)

( * ) Notice: Subject to any disclaimer, the term of this patent is extended or adjusted under 35 U.S.C. 154(b) by 4 days.

(21) Appl. No.: 15/114,483

(22) PCT Filed: Jan. 22, 2015

(86) PCT No.: PCT/EP2015/051196
§ 371 (c)(1),
(2) Date: Jul. 27, 2016

(87) PCT Pub. No.: WO2015/110498
PCT Pub. Date: Jul. 30, 2015

(65) Prior Publication Data

US 2017/0114785 A1 Apr. 27, 2017

(30) Foreign Application Priority Data

Jan. 27, 2014 (DE) ..... 10 2014 000 846
Jul. 25, 2014 (DE) ..... 20 2014 006 000 U

(51) Int. Cl.
*F01C 1/16* (2006.01)
*F03C 2/00* (2006.01)
(Continued)

(52) U.S. Cl.
CPC ..... *F04C 2/16* (2013.01); *F01C 21/007* (2013.01); *F01C 21/02* (2013.01); *F01C 21/10* (2013.01);
(Continued)

(58) Field of Classification Search
CPC ..... F04C 2/16; F04C 18/16; F04C 15/0088; F04C 29/02; F04C 2230/603; F04C 2230/604; F04C 2240/30; F04C 2240/50
(Continued)

(56) References Cited

U.S. PATENT DOCUMENTS 2,581,451 A 1/1952 Sennet
2,924,181 A 2/1960 Sennet
(Continued)

FOREIGN PATENT DOCUMENTS

DE 813341 C 9/1951
EP 0216406 A1 4/1987
(Continued)

OTHER PUBLICATIONS

International Search Report of the International Searching Authority with English Translation issued in the corresponding PCT International Application No. PCT/EP2015/051196, dated Apr. 24, 2015 (7 pages).
(Continued)

*Primary Examiner* — Theresa Trieu
(74) *Attorney, Agent, or Firm* — Raymond R. Ferrera; Adams and Reese LLP

(57) ABSTRACT

The invention relates to a screw spindle pump, with a housing (2) which surrounds a delivery chamber (5), two spindles (7, 8), namely a drive spindle (7) and an opposed running spindle (8), a housing insert (6) which is arranged in the housing (2) and in which the spindles (7, 8) are accommodated, at least one bearing element (13', 13"), which is connected to the housing insert (6) and on which bearings (12) of the spindles (7, 8) are arranged, and with at least one housing cover (14', 14"), closing a housing opening. It is the object of the invention to provide a screw spindle pump at which maintenance and inspection work can
(Continued)

be carried out more simply and cost-effectively. The invention achieves this object in that the bearing element (13', 13") together with the housing insert (6) and the spindles (7, 8) accommodated therein forms a unit (15) which, after the housing cover (14', 14") is taken off, is removable from the housing (2) through the housing opening.

14 Claims, 4 Drawing Sheets

(51) Int. Cl.

| | |
|---|---|
| ***F03C 4/00*** | (2006.01) |
| ***F04C 2/16*** | (2006.01) |
| ***F01C 21/00*** | (2006.01) |
| ***F01C 21/10*** | (2006.01) |
| ***F01C 21/02*** | (2006.01) |
| ***F04C 15/00*** | (2006.01) |
| ***F04C 18/16*** | (2006.01) |
| ***F04C 29/02*** | (2006.01) |

(52) U.S. Cl.
CPC ..... *F04C 15/0088* (2013.01); *F04C 18/16* (2013.01); *F04C 29/02* (2013.01); *F04C 2230/603* (2013.01); *F04C 2230/604* (2013.01); *F04C 2230/70* (2013.01); *F04C 2230/80* (2013.01); *F04C 2230/85* (2013.01); *F04C 2240/20* (2013.01); *F04C 2240/30* (2013.01); *F04C 2240/50* (2013.01); *F04C 2240/52* (2013.01); *F04C 2240/802* (2013.01)

(58) Field of Classification Search
USPC ..... 418/197, 202, 201.1
See application file for complete search history.

(56) References Cited

U.S. PATENT DOCUMENTS

| | | | | |
|---|---|---|---|---|
| 3,057,665 A * | 10/1962 | Zalis | F04C 18/16 418/201.1 |
| 4,767,284 A * | 8/1988 | Shiinoki | F04C 18/16 418/201.1 |
| 8,486,021 B2 * | 7/2013 | Hoshide | A61M 5/1456 604/155 |

FOREIGN PATENT DOCUMENTS

| | | |
|---|---|---|
| FR | 2174684 A1 | 10/1973 |
| GB | 541601 A | 12/1941 |
| WO | 2007020345 A2 | 2/2007 |

OTHER PUBLICATIONS

Written Opinion of the International Search Authority (Form PCT/ISA/237) with English Translation issued in the corresponding PCT International Application No. PCT/EP2015/051196, dated Apr. 24, 2015 (16 pages).

International Preliminary Report on Patentability Chapter I issued in the corresponding PCT International Application No. PCT/EP2015/051196, dated Aug. 2, 2016 (8 pages).

* cited by examiner

SCREW SPINDLE PUMP

The invention relates to a screw spindle pump, with a housing which surrounds a delivery chamber, two spindles, namely a drive spindle and an opposed running spindle, a housing insert which is arranged in the housing and in which the spindles are accommodated, at least one bearing element, which is connected to the housing insert and on which bearings of the spindles are arranged, and with at least one housing cover, closing a housing opening.

BACKGROUND OF THE INVENTION

Screw spindle pumps of this type are known in various configurations from the prior art. They are used for conveying fluids and multi-phase mixtures of a very wide variety of types. The drive spindle and the running spindle have parallel profile assemblies which mesh with one another without contact, wherein the profile assemblies together with the housing insert form positive displacement chambers which, when the spindles rotate in an opposed manner, convey the fluid axially from a suction side to a delivery side. The running spindle is connected to the drive spindle in terms of drive via a toothed transmission, as a result of which the meshing movement of the profile assemblies of the two spindles is realized. The transmission is generally located here outside the delivery chamber. The bearings of the spindles are customarily arranged on bearing elements or bearing covers which are connected, i.e. generally screwed, to the housing from the outside on opposite end sides. In the case of the known screw spindle pumps, the housing cover which outwardly seals the housing is connected to the housing via the bearing cover, i.e., for example, an end-side flange is formed on the housing, via which both the bearing cover and the housing cover are fastened to the housing by means of screw bolts. The bearing cover is fixed here between the flange of the housing and the housing cover.

In the case of screw spindle pumps, the spindles have to be removable from the housing for maintenance and inspection purposes. The known screw spindle pumps have the disadvantage here that in each case the complete pump, i.e. including the housing, has to be dismounted. The pump inlet and outlet have to be separated from the connected fluid lines. The housing covers are taken off. The entire pump housing weighing up to several tonnes is rotated by 90° such that finally, with the use of a suitable hoist, the spindles can be lifted out of the housing in the vertical direction.

Against this background, it is the object of the invention to provide a screw spindle pump at which maintenance and inspection work can be carried out more simply and rapidly and therefore also more cost-effectively.

The invention achieves this object starting from a screw spindle pump of the type mentioned at the beginning in that the bearing element together with the housing insert and the spindles accommodated therein forms a unit which, after the housing cover is taken off, is removable from the housing through the housing opening. Advantageous refinements are in each case the subject matter of the dependent claims. It should be pointed out that the features cited individually in the claims may also be combined with one another in an arbitrary and technologically expedient manner and therefore reveal further refinements of the invention.

The core concept of the invention consists in combining the housing insert with the spindles accommodated therein and the bearing elements to form a unit which can be removed as a whole from the housing of the pump for maintenance or inspection work. For this purpose, only the housing cover has to be taken off. The latter opens up the housing opening, through which the unit consisting of bearing element, housing insert and spindles is removed without further measures. In particular, in the case of the screw spindle pump according to the invention, the requirement of dismounting the pump in its entirety, i.e. including the housing, is dispensed with. The screw spindle pump according to the invention makes it possible, in other words, to leave the housing "in the field". The connections to the fluid lines connected to the pump can remain. Only the unit consisting of bearing element, housing insert which is preferably connected thereto and spindles is removed from the housing. The required work is carried out thereon (optionally after the unit is separately dismounted). The unit is then inserted again into the housing, and the housing is finally closed again by means of the housing cover.

Maintenance and inspection work on the screw spindle pump according to the invention can therefore be carried out substantially more simply and cost-effectively than on the pumps known from the prior art.

In a preferred refinement of the invention, the housing cover keeps the unit in its axial position in the housing. This means that, as previously explained, only the housing cover has to be removed in order subsequently to remove the unit consisting of bearing element, housing insert and spindles from the housing without further working steps being required.

In a further preferred refinement, the bearing element is designed as a bearing cover, the outside diameter of which is equal to the inside diameter of the housing opening. The bearing cover preferably ends flush here with the edge of the housing opening in the axial direction. In this refinement, the housing cover is connected directly to the housing, for example by screwing. The housing cover lies flat here against the bearing cover which ends flush with the edge of the housing opening, and therefore the bearing cover arranged on the end side of the unit and thus the unit consisting of bearing cover, housing insert and spindles is fixed as a whole in the axial direction.

Furthermore preferably, it is provided in the case of the screw spindle pump according to the invention that guide elements on which the unit is guided in the axial direction in the housing are arranged on the housing and/or on the unit. The guidance of the unit consisting of bearing element, housing insert and spindles in the housing facilitates the removal and reinsertion of the unit through the housing opening. The guide elements ensure that the housing is correctly oriented relative to the unit. The guidance can furthermore be advantageously configured in such a manner that the unit can slide in the axial direction out of the housing or into the latter with comparatively little resistance and therefore little application force.

Ideally, the screw spindle pump according to the invention has at least one removable guide rail arrangement which has at least one guide rail extending in the longitudinal direction of the screw spindle pump and on which the unit is guided in the axial direction in the housing. By this means, the unit can be introduced into or removed from the housing rapidly and simply. By means of the guide rail arrangement, the unit is in particular oriented exactly and can thus be inserted into the housing without jamming. Maintenance and inspection work on the screw spindle pump according to the invention can thus be carried out substantially more simply and cost-effectively than on the pumps known from the prior art.

The advantage of the removable guide rail arrangement is that, firstly, the introduction of the unit can thereby be simplified. Since the guide rail arrangement is removable, it, secondly, however does not obstruct the operation of the screw spindle pump, for example due to elements standing in the way. The removable guide rail arrangement is arrangeable on the screw spindle pump preferably with a force fit and/or form fit. By this means, the guide rail arrangement can be mounted or dismounted rapidly and simply. Ideally, screw or plug-in connections are suitable for this purpose.

The guide rail arrangement according to the invention can be arranged both on the transmission side and on the drive side of the screw spindle pump. According to the invention, drive side is understood as meaning the side on which a motor which drives the drive spindle is located. A transmission is located on the transmission side, preferably a toothed transmission which connects the running spindle to the drive spindle, as a result of which the meshing movement of the profile assemblies of the two spindles is realized. A guide rail arrangement is ideally located both on the drive side and on the transmission side.

The guide rail arrangement can have at least one support for holding or guiding the guide rail. The supports make it possible, inter alia, for the guide rails to be able to be oriented parallel to the floor or to a baseplate on which the spindle screw pump is standing.

The support can be designed as a telescopic extension or telescopic tube. In this connection, it can be lengthened by rails, tubes or rods being pulled out of one another. The support is therefore telescopic. The support preferably runs perpendicularly to the ground. In order to be able to better absorb and distribute the weight, the support can have a baseplate. However, the support may also be designed in such a manner that it has an opening through which a guide rail can be conducted. The cross section of the opening ideally corresponds precisely to the overall dimension of the guide rail. The opening is advantageously of polygonal, in particular tetragonal, design. The opening can be designed to be variable in size. For this purpose, the support can have an adjustment element which can project to a differing distance into the opening, or which can restrict that part of the opening which receives the guide rail in various ways and thereby adapts the size of the opening to the dimensions of the guide rail. This has the result that the support can be used for guide rails of different size.

The support advantageously has an adjustment means for orienting the unit and/or the guide rail. This is ideally an adjustment screw. The guide rail can be oriented particularly precisely by means of the adjustment means. By this means, the axes of the pump housing and of the unit can easily be brought into alignment.

The support can be arranged both on the housing and on the guide rail. The configuration of the support depends in particular on the guide rail which is to be supported.

The guide rail arrangement preferably has two guide rails which in particular run parallel to each other. By means of the two rails running parallel, it can be ensured that the unit is oriented precisely parallel to the floor and can be introduced with the correct orientation into the housing. The guide rails are arrangeable on the housing. The guide rails can be connected to each other by means of a transverse strut. By this means, the guide rail arrangement is mechanically reinforced, as a result of which it can reliably absorb the high weight of the unit without breaking in the process.

According to the invention, a guide rail arrangement with two guide rails is preferably arranged on the transmission side of the screw spindle pump.

The guide rails advantageously each have a support at the end opposite the housing, as a result of which they can be oriented parallel to the floor. The supports are preferably telescopic. The supports can also be connected to the transverse strut.

The guide rail can preferably have a groove. Particularly reliable guidance of the element to be guided is ensured by means of the groove. The groove preferably extends in the longitudinal direction of the guide rail. The groove ideally extends over the entire longitudinal extent of the guide rail.

A supporting element can be arranged on the housing insert or on the unit. The supporting element runs in particular horizontally and can at least partially rest on the guide rails. By means of the supporting element, the unit can be held by the rails and introduced into the housing along the guide rails. The supporting element is preferably arranged on a base surface of the housing insert.

The supporting element can have roller-shaped bodies. The roller-shaped bodies are preferably arranged on the supporting element in such a manner that they can come into contact with a guide rail. The use of rollers permits the unit to be displaced with little friction. The rollers are ideally arranged at the ends of the supporting element and can thus roll along the two rails running parallel to each other, in particular in the grooves thereof.

The supporting element can have at least one adjustment means, in particular an adjustment screw. By means of the adjustment means, the unit can be oriented both in the vertical and in the horizontal direction.

In one embodiment, the guide rail can be arranged on the housing insert or on the unit. The guide rail here is ideally then arranged on the drive side of the screw spindle pump. A support guiding the guide rail is preferably arranged on the drive side of the housing. In order to be able to orient the guide rail, the support can have at least one adjustment means. The support preferably has an opening through which the guide rail can be conducted.

The guide rail is ideally of multi-part design. It is composed of more than one, and at least two, parts which are arranged one behind another and are detachable from one another. In the event of confined space conditions between motor and the housing, that part of the guide rail which protrudes on the drive side can therefore be removed. The guide rail therefore does not stand in the way of the unit being pushed into the housing. The individual parts of the guide rail can be connected to one another preferably with a force fit and/or form fit. A screw connection has been shown to be particularly suitable.

The mounting of the guide rail arrangement is described below in an embodiment:

The transmission-side guide rail and the support for the drive-side guide rail are mounted on the pump housing. The supports for the transmission-side guide rails are mounted on the guide rails and are oriented in such a manner that the guide rails run parallel to the baseplate. The transmission-side housing insert support and the drive-side guide rail are subsequently fastened to the unit. The unit is positioned in the pump housing in such a manner that the drive-side guide rail can be held by the drive-side support. Furthermore, the unit with the transmission-side housing insert support is placed onto the transmission-side guide rails. The rollers of the housing insert support are intended to be positioned here in the grooves of the guide rails in such a manner that they can roll with little friction. In order to align the axes of the pump housing and of the unit, the unit is oriented in a horizontal and vertical position on the transmission-side housing insert support and the support for the drive-side guide rail with the aid of orientation means. The unit can then be pushed into the pump housing. If there is only little space between the pump and the motor, then, in the case of a drive-side guide rail of multi-part design, the part protruding on the drive side can be dismounted. After the unit is completely arranged in the pump housing, the guide rail arrangements can be dismounted again. Once the housing is closed with a cover, the screw spindle pump is then ready for operation.

For the removal of the unit from the pump housing, the mounting described above takes place in the reverse sequence.

Furthermore, in the case of the screw spindle pump according to the invention, a rotation lock is preferably provided which prevents an axial rotation of the unit consisting of bearing element, housing insert and spindles. As explained above, the unit is preferably kept in its axial position without further fastening elements, that is to say, only by means of the housing cover or the housing covers. According to the invention, a rotation lock can be provided, for example in the form of form fit elements which are formed on the housing cover and engage in the unit (for example in the bearing cover) in order in a simple and reliable manner to prevent inadvertent rotation or erroneous mounting of the pump after the maintenance or inspection work has been carried out.

In a further preferred refinement of the screw spindle pump according to the invention, lubricant channels which serve for lubricating the bearings of the spindles are formed in the bearing element. The lubricant channels open here into at least one end-side lubricant opening in the bearing element. It is customary in the case of screw spindle pumps to connect the bearings to inflow and outflow channels for lubricant, via which lubricant can be supplied and removed continuously. For this purpose, the pump is connected to an external lubricant supply system. According to the invention, it is preferably provided that the lubricant is supplied and removed via the end side of the bearing element.

Corresponding lubricant channels can preferably then be provided in the housing cover, said lubricant channels passing from the front side of the housing cover to the rear side thereof, wherein a rear-side opening in the lubricant channel of the housing cover comes to overlap with the end-side lubricant opening of the bearing element when the housing cover is closed. The invention therefore permits reliable lubrication of the spindles in the customary manner via corresponding lubricant channels formed in the bearing element. The lubricant is preferably supplied and removed here via the housing cover. In order to separate or to restore the supply and removal of lubricant when the unit has been removed from the housing, the lubricant channels do not have to be separated or connected again separately. When the housing cover is opened, the lubricant connection is automatically interrupted without further working steps. When the housing cover is closed after the unit has been reinserted, the lubricant connection is automatically produced correctly again without further working steps.

As in the case of known screw spindle pumps, in the case of the screw spindle pump according to the invention, a transmission housing which accommodates and protects a transmission (for example toothed transmission) connecting the drive spindle to the running spindle therein can be formed on the housing cover.

The invention and the technical environment are explained in more detail below with reference to the figures. It should be pointed out that the figures show a particularly preferred variant embodiment of the invention. However, the invention is not restricted to the variant embodiment shown. In particular, the invention, if it is technically expedient, includes arbitrary combinations of the technical features that are listed in the claims or are described in the description as being relevant to the invention.

SUMMARY OF THE INVENTION

Not Applicable

DETAILED DESCRIPTION OF THE DRAWINGS

Figure 1:
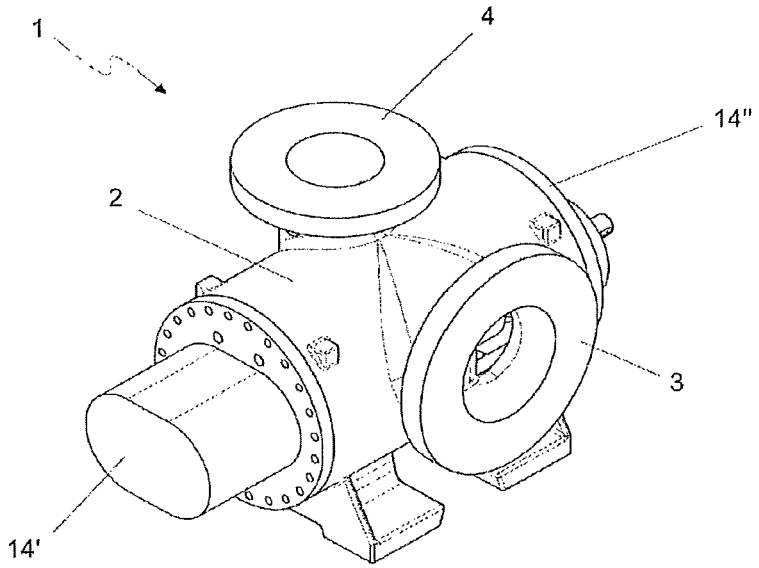
FIG. 1 shows a top view of a screw spindle pump according to the invention.

The figures show an exemplary embodiment of a screw spindle pump according to the invention that is denoted overall by the reference number 1.

The latter has a housing 2 with an integrally formed inlet 3 and outlet 4. The housing 2 surrounds a delivery chamber 5 of the pump, in which a housing insert 6 is located. The housing insert 6 accommodates a drive spindle 7 and an opposed running spindle 8 therein. Two profile assemblies 7', 7" line of the drive spindle 7 are indicated schematically in FIG. 4. The profile assemblies of the drive spindle 7 and of the running spindle 8 mesh with each other and, together with pressure chambers 6' and 6" of the housing insert 6 that surround the profile assemblies with a small gap, form positive displacement chambers through which a fluid to be conveyed is conveyed axially from inlet chambers 9, which are connected to the inlet 3, into an outlet chamber 10 which is connected to the outlet 4. Partitions 11 of the housing insert 6 that are sealed in relation to the inner wall of the housing 2 seal the inlet chambers 9 in relation to the outlet chamber 10.

Bearings 12 of the spindles 7, 8 are formed on front- and rear-side bearing elements 13' and 13" in the form of bearing covers. The bearings 12 are rolling bearings.

A housing cover 14', 14" which closes a front-side or a rear-side opening in the housing 2 is arranged in each case on the front side and on the rear side of the housing 2. As illustrated in the figures, the housing covers 14', 14" have screw connection collars, via which the housing covers 14', 14" can be screwed to the housing 2.

Figure 3:
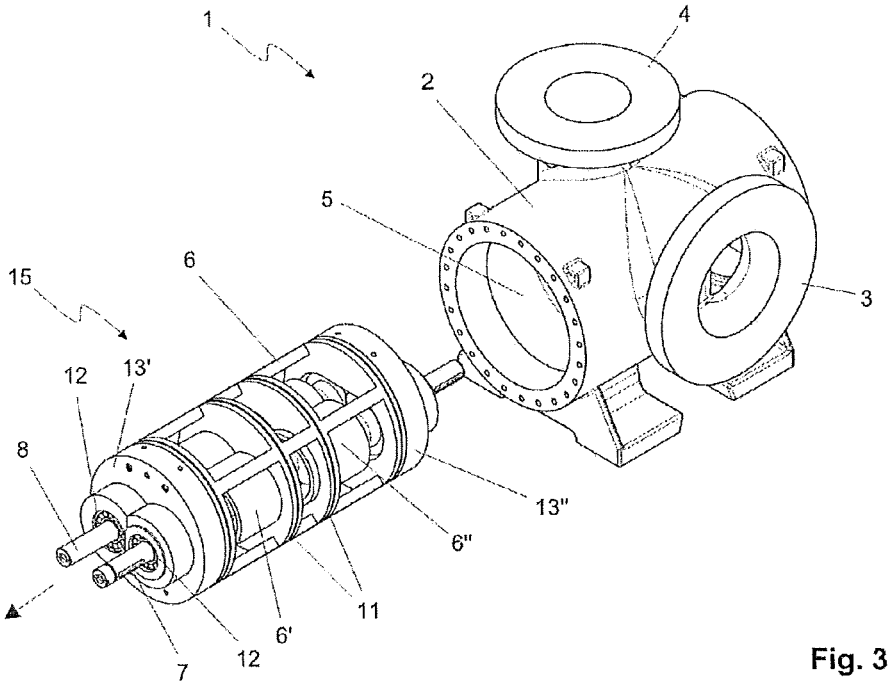
FIG. 3 shows the screw spindle pump according to FIGS. 1 and 2 with the unit consisting of bearing elements, housing insert and spindles removed.

According to the invention, it is provided that the bearing elements 13', 13" together with the housing insert 6 and the spindles 7, 8 accommodated in the latter form a unit which is denoted overall in FIG. 3 by the reference number 15. As shown in FIG. 3, the unit 15 is removable from the housing 2, through the front opening therein, in the direction of the arrow after the housing cover 14' has been taken off.

Figure 2:
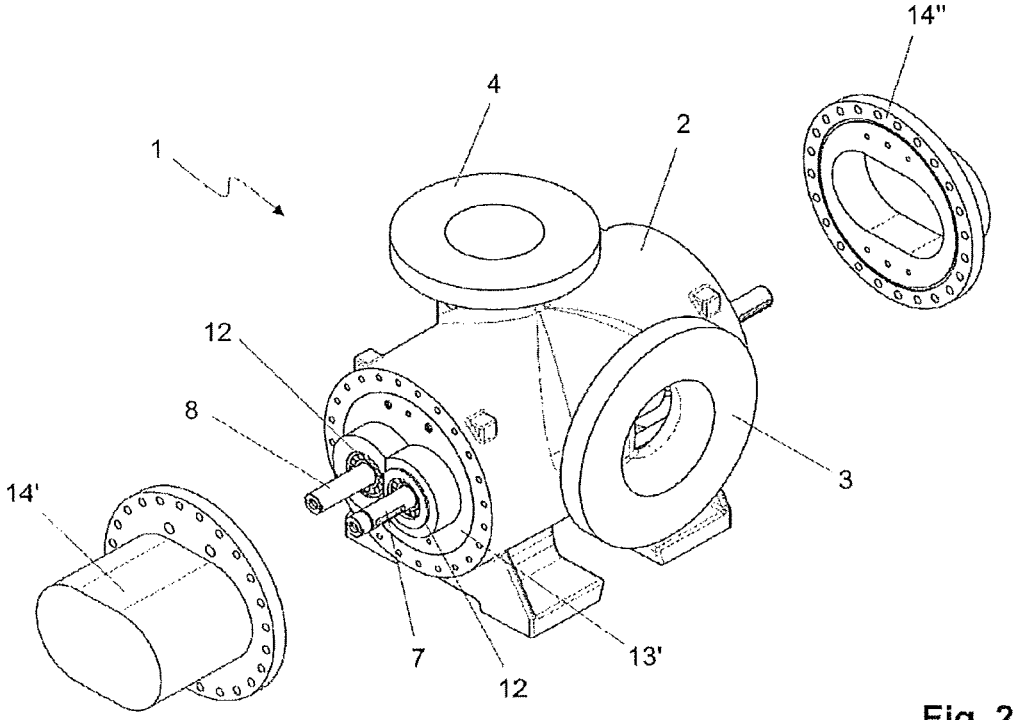
FIG. 2 shows a screw spindle pump according to FIG. 1 with front- and rear-side housing covers dismounted.
Figure 4:
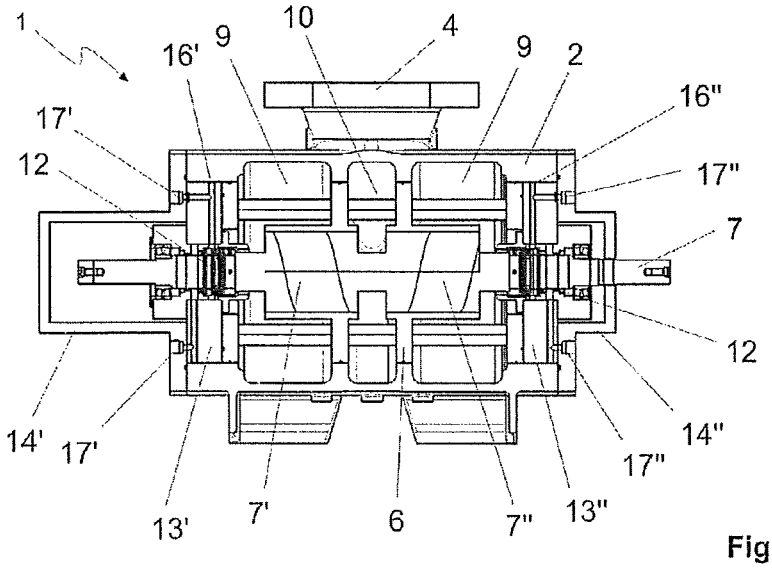
FIG. 4 shows a screw spindle pump according to the invention in a sectioned side view.

It can be seen in FIGS. 2 and 4 that the housing covers 14', 14" keep the unit 15 consisting of bearing elements 13', 13", housing insert 6 and spindles 7, 8 in its axial position. The outside diameter of the bearing elements 13', 13", which is designed as bearing covers, is equal here to the inside diameter of the front- and rear-side housing openings, wherein the bearing elements 13', 13" each end flush in the axial direction on the end side of the housing 2 with the edge of the housing opening, and therefore the housing covers 14", 14" which are connected to the housing 2 lie flat against the bearing elements 13', 13" and thus keep the entire unit 15 in the axial position shown in FIGS. 2 and 4.

As FIG. 4 shows, lubricant channels 16' and 16" which serve to lubricate the bearings 12 are respectively formed in the bearing elements 13', 13". The lubricant channels 16', 16" open into end-side openings in the bearing elements 13' and 13", respectively, wherein said openings correspond to openings in lubricant channels 17', 17" formed in the housing covers 14', 14", and therefore lubricant can be supplied and removed via the housing covers 14', 14".

A transmission housing which accommodates a toothed transmission (not illustrated) which connects the drive spindle 7 to the running spindle 8 is formed in the housing cover 14'.

Figure 5:
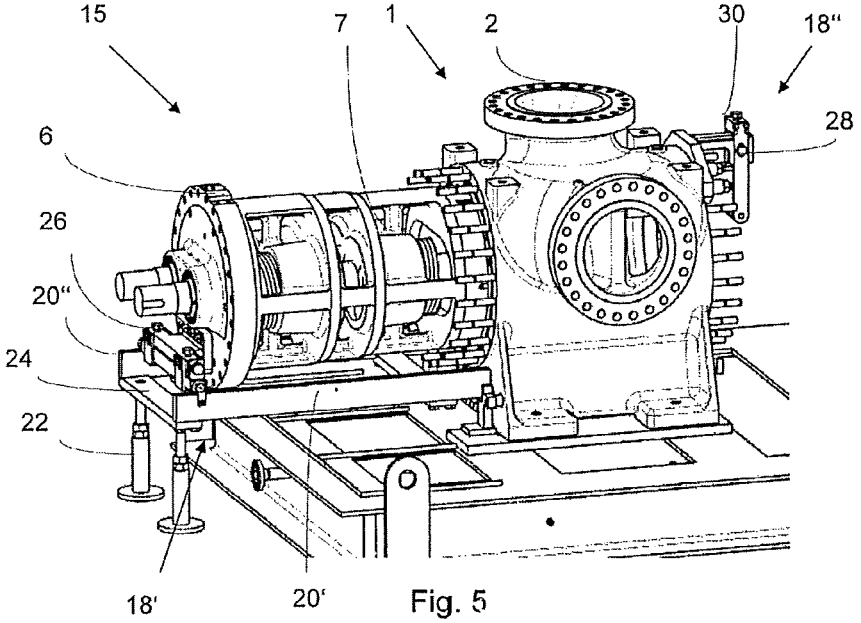
FIG. 5 shows a schematic view of a screw spindle pump according to the invention with an embodiment of a rail guide arrangement.

FIG. 5 shows a schematic view of an embodiment of a screw spindle pump 1 according to the invention. The screw spindle pump 1 comprises a housing 2 which surrounds a delivery chamber, two spindles, a drive spindle 7 and an opposed running spindle 8, a housing insert 6 which is arranged in the housing 2 and in which the spindles 7, 8 are accommodated, and at least one bearing element 13 which is connected to the housing insert 2 and on which bearings 12 of the spindles 7, 8 are arranged. Furthermore, the screw spindle pump 1 has at least one removable guide rail arrangement 18', 18" which has at least one guide rail 20, 28 extending in the longitudinal direction of the screw spindle pump 1. In FIG. 1, the screw spindle pump 1 has both a transmission-side guide rail arrangement 18' and a drive-side guide rail arrangement 18".

The transmission-side guide rail arrangement 18' has two guide rails 20', 20" which run parallel to each other. By means of the two rails 20', 20" running parallel, it can be ensured that the unit 15 is oriented precisely parallel to the floor and can be introduced in the correct orientation into the housing 2. The guide rails 20', 20" are arranged on the housing 2. The guide rails 20', 20" are connected to each other by means of a transverse strut 24. By this means, the guide rail arrangement 18' is mechanically reinforced, as a result of which it can reliably absorb the high weight of the unit 15 without breaking in the process.

The transmission-side guide rails 20', 20" each have a support 22 at the end opposite the housing 2, as a result of which they can be oriented parallel to the floor. The supports 22 run perpendicularly to the floor and are preferably of telescopic design. The supports 22 are connected to the transverse strut 24.

A supporting element 26 is arranged on the housing insert 6 or on the unit 15. The supporting element 26 runs in particular horizontally and can at least partially rest on the guide rails 20', 20". By means of the supporting element 26, the unit 15 can be held by the rails 20', 20" and introduced into the housing 2 along the guide rails 20', 20". The supporting element 26 is preferably arranged on a base surface of the housing insert 6.

Furthermore, the screw spindle pump 1 has a drive-side guide rail arrangement 18". The guide rail arrangement 18" comprises a support 30 arranged on the housing 2 and a guide rail 28 arranged on the housing insert 6 or on the unit 15.

Figure 6:
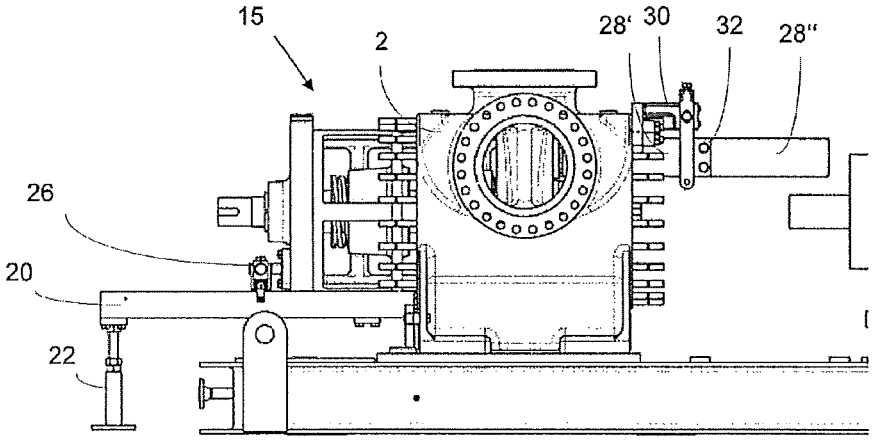
FIG. 6 shows a schematic view of a screw spindle pump according to the invention with a further embodiment of a rail guide arrangement.

FIG. 6 shows a schematic view of a further embodiment of a screw spindle pump 1 according to the invention. In this embodiment, the guide rail 28 is of multi-part design. It is composed of more than one, and at least two, parts 28', 28" which are arranged one behind another and are detachable from one another. In the event of confined space conditions between motor and the housing 2, that part 28" of the guide rail 28 which protrudes on the drive side will therefore be removed. The guide rail 28 therefore does not stand in the way of the unit 15 being pushed into the housing 2. The individual parts 28', 28" of the guide rail 28 are preferably connected to one another with a force fit and/or form fit, ideally by means of a screw connection 32. By this means, the parts 28', 28" can be rapidly mounted together and dismounted from one another again.

Figure 7:
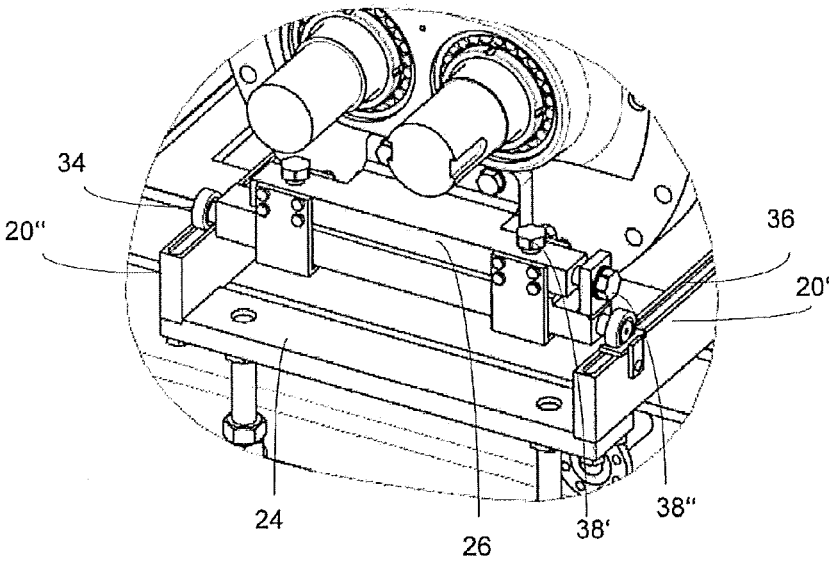
FIG. 7 shows a schematic view of an embodiment of a transmission-side rail guide arrangement according to the invention.

FIG. 7 shows a schematic view of an embodiment of a transmission-side guide rail arrangement 18' according to the invention. The guide rails 20', 20" each have a groove 36. Particularly reliable guidance of the element which is to be guided is ensured by the groove 36. The groove 36 extends in the longitudinal direction of the guide rails 20', 20". The groove 36 ideally extends over the entire longitudinal extent of the guide rails 20', 20".

The supporting element 26 has roller-shaped bodies 34, preferably rollers. The rollers 34 are arranged on the supporting element 26 in such a manner that they can each come into contact with a guide rail 20', 20". The use of rollers 34 makes it possible for the unit 15 to be displaced with little friction. The rollers 34 are ideally arranged at the ends of the supporting element 26 and can thus roll along the two rails 20', 20" running parallel to each other, in particular in the grooves 36 thereof.

The supporting element 26 has at least one adjustment means 38', 38", in particular an adjustment screw. By means of the adjustment means 38', 38", the unit can be oriented both in the vertical and in the horizontal direction.

Figure 8:
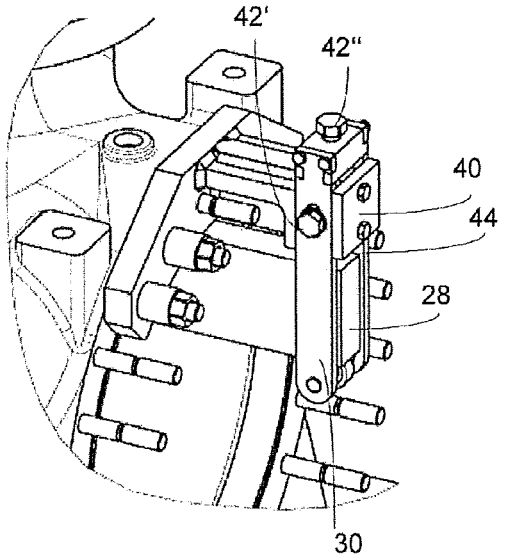
FIG. 8 shows a schematic view of an embodiment of a drive-side rail guide arrangement according to the invention.

FIG. 8 shows a schematic view of an embodiment of a drive-side rail guide arrangement 18" according to the invention. The support 30 has an opening 44 through which the guide rail 28 can be conducted. The cross section of the opening 44 ideally corresponds precisely to the overall dimension of the guide rail 28. The opening 44 is advantageously of tetragonal design. The opening 44 can be designed to be variable in size. For this purpose, the support 30 can have an adjustment element 40 which can restrict that part of the opening 44 which receives the guide rail 28 in different ways and thereby adapts the size of the opening 44 to the dimensions of the guide rail 28. This has the result that the support 30 can be used for guide rails 28 of different size.

Furthermore, the support 30 also has adjustment screws 42', 42" in order to be able to orient the unit 15 both in the vertical direction and in the horizontal direction.

LIST OF REFERENCE SIGNS

1 Screw spindle pump
2 Housing
3 Inlet
4 Outlet
5 Delivery chamber
6 Housing insert
7 Drive spindle

8 Running spindle
9 Inlet chamber
10 Outlet chamber
11 Partitions
12 Bearing
13 Bearing elements
14 Housing cover
15 Unit
16 Lubricant channels
18 Guide rail arrangement
20', 20" Guide rail (on the transmission side)
22 Support (on the transmission side)
24 Transverse strut
26 Support of unit
28 Guide rail (on the drive side)
28', 28" Dividable guide rail (on the drive side)
30 Support (on the drive side)
32 Connecting element of guide rail
34 Rollers
36 Groove
38 Adjustment means (support of unit)
40 Adjustment element of opening
42 Adjustment means (support (on the drive side))
44 Opening

The invention claimed is:

1. A screw spindle pump, with a housing (2) which surrounds a delivery chamber (5), two spindles (7, 8), namely a drive spindle (7) and an opposed running spindle (8), a housing insert (6) which is arranged in the housing (2) and in which the spindles (7, 8) are accommodated, at least one bearing element (13', 13"), which is connected to the housing insert (6) and on which bearings (12) of the spindles (7, 8) are arranged, and with at least one housing cover (14', 14"), closing a housing opening, characterized in that the bearing element (13', 13") together with the housing insert (6) and the spindles (7, 8) accommodated therein forms a unit (15) which, after the housing cover (14', 14") is taken off, is removable from the housing (2) through the housing opening, wherein the screw spindle pump further comprises one removable guide rail arrangement (18) which has at least one guide rail (20, 28) which extends in a longitudinal direction of the screw spindle pump and on which the unit (15) is guided in an axial direction in the housing (2).

2. The screw spindle pump as claimed in claim 1, wherein the housing cover (14', 14") keeps the unit (15) in its axial position in the housing (2).

3. The screw spindle pump as claimed in claim 1 wherein the bearing element (13', 13") is a bearing cover, an outside diameter of which is equal to an inside diameter of the housing opening.

4. The screw spindle pump as claimed in claim 1, further comprising a rotation lock which prevents an axial rotation of the unit.

5. The screw spindle pump as claimed in claim 1, characterized by lubricant channels (16', 16") formed in the bearing element (13', 13") for lubricating the bearings (12), wherein the lubricant channels (16', 16") open into at least one end-side lubricant opening in the bearing element (13', 13").

6. The screw spindle pump as claimed in claim 1, wherein the guide rail arrangement (18) has at least one support (22, 30) for holding or guiding the guide rail (20, 28).

7. The screw spindle pump as claimed in claim 1, wherein the support (22, 30) has an adjustment means (38, 42) for orienting the unit (15) or the guide rail (20, 28).

8. The screw spindle pump as claimed in claim 1, wherein the guide rail arrangement (18) has two guide rails (20) which run parallel to each other and are arranged on the housing (2).

9. The screw spindle pump as claimed in claim 8, wherein the guide rails (20) each have a groove (36) which extends in the longitudinal direction of the guide rails (20).

10. The screw spindle pump as claimed in claim 9, wherein an adjustment means (38) is arranged on the supporting element (26).

11. The screw spindle pump as claimed in claim 8, wherein a supporting element (26) which runs horizontally is arranged on the housing insert (6) on one of the base surfaces thereof, and at least partially rests on the guide rails (20).

12. The screw spindle pump as claimed in claim 11, wherein the supporting element (26) has rollers (34) which act on the guide rails (20).

13. The screw spindle pump as claimed in claim 1, wherein the guide rail (28) is composed of a plurality of parts which are arranged one behind another and are detachable from one another.

14. The screw spindle pump as claimed in claim 1, wherein the guide rail arrangement (18) is arranged on a transmission side or drive side of the screw spindle pump.

* * * * *